United States Patent [19]

Masui et al.

[11] Patent Number: 4,658,620

[45] Date of Patent: Apr. 21, 1987

[54] TANDEM MILL

[75] Inventors: Takeshi Masui, Hyogo, Japan; Eizo Yasui, Chicago, Ill.; Yukio Matsuda, Ibaraki, Japan

[73] Assignee: Sumitomo Metal Industries, Ltc., Osaka, Japan

[21] Appl. No.: 840,468

[22] Filed: Mar. 13, 1986

Related U.S. Application Data

[63] Continuation of Ser. No. 642,691, Aug. 20, 1984, abandoned, which is a continuation of Ser. No. 283,542, Jul. 14, 1981, abandoned.

[30] Foreign Application Priority Data

Aug. 8, 1980 [JP] Japan ..... 55-109545
Nov. 26, 1980 [JP] Japan ..... 55-166098

[51] Int. Cl.[4] ..... B21B 1/04
[52] U.S. Cl. ..... 72/234

[58] Field of Search ..... 72/234, 241, 243, 244, 72/245, 246, 247, 366

[56] References Cited

U.S. PATENT DOCUMENTS 2,038,917 4/1936 Wilson et al. ..... 72/234

FOREIGN PATENT DOCUMENTS 48050 5/1978 Japan ..... 72/241
68106 5/1980 Japan ..... 72/241

*Primary Examiner*—Lowell A. Larson
*Attorney, Agent, or Firm*—Burns, Doane, Swecker & Mathis

[57] ABSTRACT

A tandem mill has a plurality of stands and has at each stand one mill suitably selected from a common four-high mill, a sleeve sliding mill, an intermediate back-up roll shifting mill, and a sleeve expanding mill.

1 Claim, 5 Drawing Figures

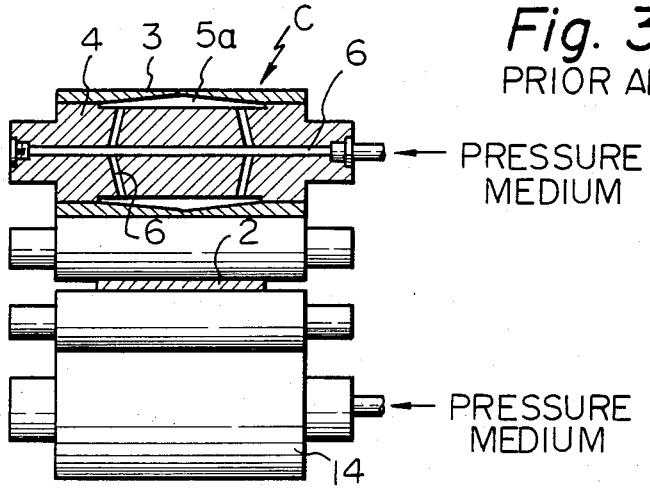
Fig. 3
PRIOR ART
Fig. 4
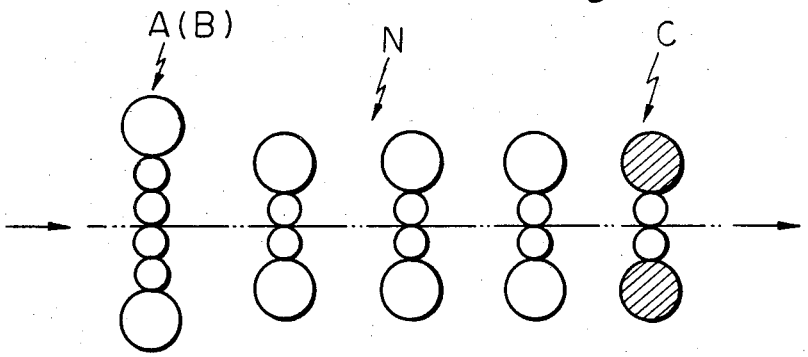
Fig. 5
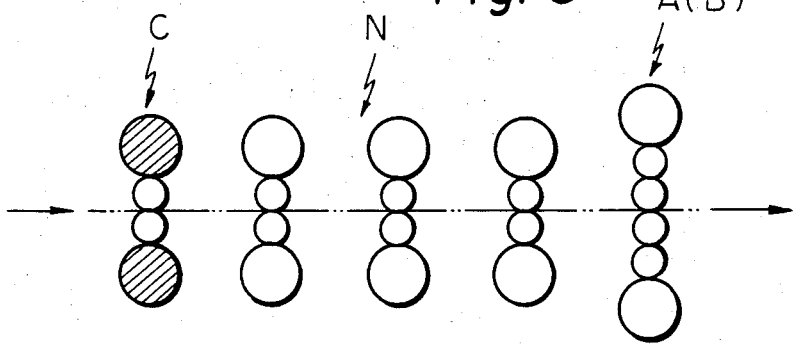

TANDEM MILL

This application is a continuation of application Ser. No. 642,691, filed Aug. 20, 1984, now abandoned, which is a continuation of application Ser. No. 283,542, filed July 14, 1981 (now abandoned).

BACKGROUND OF THE INVENTION

The present invention relates to a tandem mill suitable for control of the sectional profile and shape of rolled articles.

A cold or hot tandem mill generally comprises serially arranged four to seven stands of common four-high mills (hereinafter called rolling mill N) including work rolls and back-up rolls and, preferably, roll benders. Recently, there has been a growing demand from users for steel sheets of high quality, particularly for such sheets having uniform thickness distribution in the lateral direction (that is, free from sheet crown and edge drop) and good flatness.

In a conventional tandem mill in which the roll crown of each stand is varied according to variation in the width, thickness and quality of the material which was rolled by using roll bending effectively, it has been impossible to obtain the desired flatness since there were provided too many kinds of initial crown of the work rolls which necessitated too frequent exchange of rolls, resulting in decrease in production efficiency.

While roll bending has been fairly effective, the conventional roll bending method has a limit to the ability for correcting and controlling the shape of material to be rolled and has not been sufficiently effective particularly in the case where the variation in rolling width is large.

As a method for improving the ability to control the sectional profile and the shape, the technical idea of providing the back-up roll of the tandem mill with steps has been proposed. This stepped back-up roll has a flat central portion and tapered ends, and the flat central portion is somewhat smaller in width than the material to be rolled. The back-up roll was provided with the steps firstly for minimizing the bending in the work roll by the rolling load and secondly for increasing the correcting ability due to the roll bending. The stepped back-up roll, however, has a disadvantage that each change in the sheet width requires an exchange of rolls according to the sheet width, which thereby decreases the productivity and increases the number of reverse rolls required. Accordingly, there have been developed various back-up rolls requiring no exchange of rolls even for changes in the sheet width and yet which are capable of providing the same effects as the stepped back-up rolls.

One of such rolling mills is a sliding expandable sleeve mill (hereinafter called rolling mill A) in which the expandable sleeve of the sleeve roll is slidable in the direction of the roll axis. An example of the rolling mill A is shown in FIG. 1. The rolling mill A is characterized in that a sleeve 3 is fitted onto each of back-up rolls 4 and the sleeve 3 is movable in the direction of the roll axis by a hydraulic cylinder 7. For movement of the sleeve 3 in the direction of the width of a material 2 to be rolled, a pressure medium is supplied from a medium passage 6 to a pressure acting groove 5 to release the force in the sleeve 3 holding it to the roll 4 to thereby facilitate the movement of the sleeve 3. The rolling mill A is preferably provided with a roll bender.

A further example is an intermediate back-up roll shifting mill (hereinafter called rolling mill B) which is a six-high mill having intermediate back-up rolls movable in the direction of the roll axis. The rolling mill B incorporates a pair of intermediate back-up rolls 10 between a pair of upper and lower work rolls 8 and a pair of back-up rolls 11, respectively, as shown in FIG. 2. The intermediate back-up rolls 10 are adjustably movable in the direction of the roll axis by driving couplers 12 according to the amount of variation of the sheet width of the material 2 to be rolled.

A still further example is an expandable fixed sleeve mill (hereinafter called rolling mill C) in which back-up rolls (variable crown, or VC, rolls) are radially expandable. The rolling mill C has a construction in which, as shown in FIG. 3, a sleeve 3 is fitted onto each of back-up rolls 4 and a pressure medium is supplied through medium passage 6 to a pressure chamber 5*a* defined between the roll 4 and the sleeve 3 to adjust the pressure of the medium, to thereby control the amount of the radial expansion of the sleeve 3. While FIG. 3 shows the VC roll having only one pressure chamber, a VC roll having two or more pressure chambers may, of course, be used if required.

The rolling mills described above have their respective characteristic features and each of them has effects in reducing sheet crown and edge drop and high ability to control the shape. While the rolling mills A and B have a noticeable shape control effect for any sheet width, it will be too costly to provide one of these rolling mills at every stand. On the other hand, while the rolling mill C is somewhat less adaptive than the rolling mills A or B to sheet width, it can be manufactured at a lower cost and yet is higher in response speed.

Further, in remodeling a conventional rolling mill N, while rolling mills A and C are relatively easily formed from the mill N, a rolling mill B requires much engineering work such as housing grinding and closure of the mill operation during such work.

Accordingly, an object of the present invention is to provide a tandem mill which has a low cost and excellent performance, by suitably incorporating the above-described rolling mills A, B, C, and/or N in a tandem mill.

SUMMARY OF THE INVENTION

In the tandem mill comprising a plurality of stands according to the present invention, a suitable mill taken from the group consisting of the common bendable roll four-high mill N, the sliding sleeve mill A, the intermediate back-up roll shifting mill B, and the expandable sleeve mill C is selected and located at each stand.

Table 1 shows examples of a typical arrangement of the rolling mills in the tandem mill according to the present invention.

TABLE 1

| Arrangement of Rolling Mills | Upstream Stand | Downstream Stand | Other Stands |
|---|---|---|---|
| I | A | C | N |
| II | B | C | N |
| III | C | A | N |
| IV | C | B | N |

In the arrangement I or II of Table 1, in the case where a rolling mill A or B is provided as the upstream stand to vary positively the sheet crown by utilizing the lateral flow of the material (for example, to reduce the roll deflection to thereby reduce the sheet crown), a shape defect of center buckle is liable to occur. In order to correct the center buckle, accordingly, a rolling mill C having a high response and a high shape correcting function is provided as the downstream stand.

In movably adjusting the sleeves or the intermediate back-up rolls of the rolling mills A and B, the work rolls and the back-up rolls are movably adjusted in advance so that the length of the plane of contact between them is equal to or less than the sheet width. By doing this, the ability to adjust the roll deflection is substantially equal to that of the stepped back-up roll described hereinabove, which makes it possible to obtain the sheet profile improving effect and the shape correcting effect equal to those provided by a stepped back-up roll.

In the arrangement III or IV of Table 1, as the downstream stand of the tandem mill there is provided a rolling mill A or B which does not require roll exchange for any variation in the sheet width and yet is capable of exhibiting a control function equal to that of the stepped back-up roll, and as the upstream stand there is provided the rolling mill C which has a high shape correcting function and a high response, whereby there is provided a tandem mill having a high capability of shape control, whereby sheet crown and edge drop are reduced and steel sheets having a high flatness are produced.

While the rolling mills A, B and C have been described hereinabove as used in a four-high and six-high mills, it will be obvious to those skilled in the art that these rolling mills may be used in a multiple roll mill. Further, common four-high mills or the like may be combined to such an extent that they will not be an obstacle to this invention.

BRIEF DESCRIPTION OF THE DRAWINGS

The invention will be better understood from the following description taken in connection with the accompanying drawings in which:

FIG. 3 is a partially cut-away front view of a conventional sleeve expanding mill; and FIGS. 4 and 5 are schematic illustrations of embodiments of the tandem mill according to the present invention.

DETAILED DESCRIPTION OF THE PREFERRED EMBODIMENT

Figure 1:
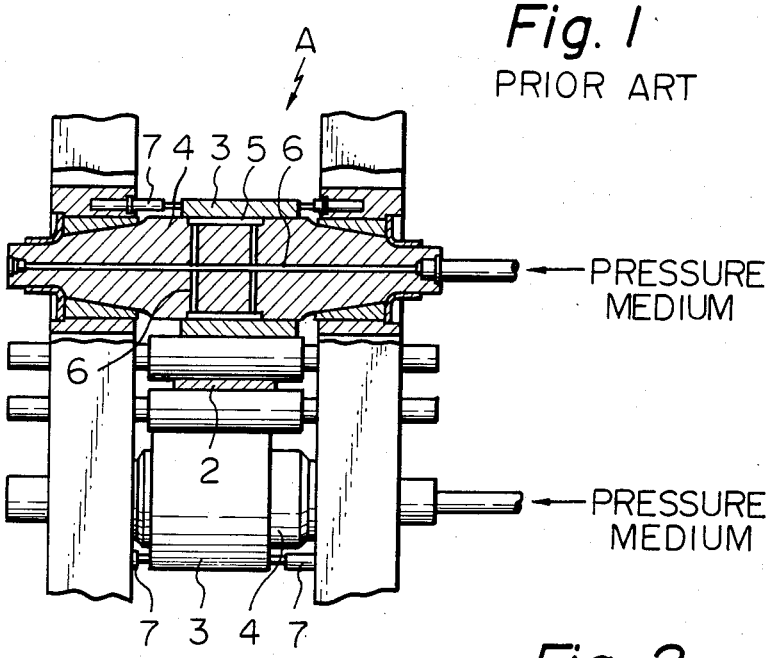
Fig. 1 PRIOR ART
FIG. 1 is a partially cut-away front view of a conventional sleeve sliding mill.
Figure 2:
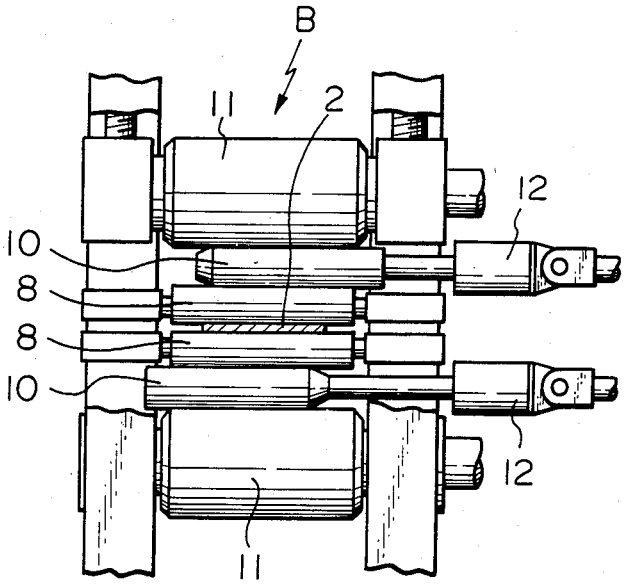
Fig. 2 PRIOR ART
FIG. 2 is a front view of a conventional back-up roll shifting mill.

Results of examples of cold and hot rolling operations using the tandem mill according to the present invention and the conventional four-high mill, respectively, will be described in comparison with each other.

In an embodiment of the tandem mill according to the present invention comprising, for example, five stands as shown in FIG. 4, at least one of the upstream stands is a rolling mill A or B, at least one of the downstream stands is a rolling mill C and the rest of the stands are rolling mills N.

In another embodiment of the tandem mill according to the present invention comprising, for example, five stands as shown in FIG. 5, at least one of the upstream stands is a rolling mill C, at least one of the downstream stands is a rolling mill A or B, and the rest of the stands are rolling mills N.

The results of the cold and the hot rolling operations will now be described with respect to the typical arrangements of the various rolling mills shown in Table 1.

(i)
COLD ROLLING (1) Typical dimensions and functions of various rolling mills in the tandem cold rolling mill Rolling Mill A
- Work Roll: diameter 560 mm×barrel length 1704 mm
- Back-up Roll: diameter 1500 mm×barrel length 1704 mm
- Pressure during Sleeve Shift: 300~500 Kg/cm$^2$ Rolling Mill B
- Work Roll: diameter 508 mm×barrel length 1704 mm
- Intermediate Back-up Roll: diameter 530 mm×barrel length 1704 mm
- Back-up Roll: diameter 1500 mm×barrel length 1704 mm
- Roll Bending Force: increase 50 ton constant Rolling Mill C
- Work Roll: diameter 560 mm×barrel length 1704 mm
- Back-up Roll: diameter 1500 mm×barrel length 1704 mm
- Medium Pressure: 0~500 Kg/cm$^2$
- Amount of Sleeve Expansion: maximum 0.23 mm/radius Rolling Mill N
- Work Roll: diameter 560 mm×barrel length 1704 mm
- Back-up Roll: diameter 1500 mm×barrel length 1704 mm (2) Material Used Hot rolled strip (pickled):
thickness 2.8 mm×width 1224 mm (3) Rolling Condition The material was rolled by the tandem mill comprising five stands in a schedule for reducing the thickness of the material from the initial thickness of 2.8 mm gradually to the thicknesses of 2.01 mm, 1.46 mm, 1.11 mm, 0.85 mm and 0.8 mm, respectively.

The rolling mill C was adjusted properly so as to provide an exit side shape which will not be any obstacle to rolling in the range of the internal pressure of the sleeve roll 0~500 Kg/cm$^2$.

(4) The rolling results with respect to the arrangements of rolling mills I and II of Table 1 are shown in Table 2.

TABLE 2

| | Type of Mill No. | Mill Arrangement Stand No. 1 | 2 | 3 | 4 | 5 | Rolling Results Cr 50 (μ) | ED 50-5 (μ) | Finished Shape |
|---|---|---|---|---|---|---|---|---|---|
| Conventional Method | 1 | N | N | N | N | N | 30 | 50 | X |
| Present | 2 | A | N | N | N | C | 25 | 43 | ○ |

TABLE 2-continued

| | Type of Mill No. | Mill Arrangement Stand No. 1 | 2 | 3 | 4 | 5 | Rolling Results Cr 50 (μ) | ED 50-5 (μ) | Finished Shape |
|---|---|---|---|---|---|---|---|---|---|
| Invention | 3 | B | N | N | N | C | 25 | 43 | ○ |
| | 4 | A | N | N | N | N | 26 | 45 | X |
| | 5 | A | A | N | N | C | 21 | 33 | ○ |
| | 6 | A | A | N | C | C | 17 | 31 | ◎ |
| | 7 | B | B | N | N | N | 20 | 35 | X |
| | 8 | B | B | B | C | C | 17 | 30 | ◎ |
| | 9 | A | B | C | C | C | 18 | 31 | ◎ |
| | 10 | A | A | A | N | N | 21 | 36 | X |
| | 11 | A | C | C | C | C | 16 | 29 | ◎ |
| | 12 | B | C | C | C | C | 16 | 29 | ◎ |
| | 13 | N | C | C | C | C | 19 | 44 | ◎ |

(Size of product, thickness 0.8 mm × width 1500 mm)

The internal pressure of the rolling mill C was established as 460 Kg/cm$^2$, 480 Kg/cm$^2$, and 490 Kg/cm$^2$ at the Stands Nos. 2, 3 and 4, respectively, and was successively adjusted at the Stand No. 5 so as to provide a satisfactory shape.

In Table 2, the mark "Cr 50" denotes the difference in the sheet thickness (sheet crown) between the center of the sheet width and a position 50 mm from the sheet edge, and the mark "ED 50-5" denotes the difference in the sheet thickness (edge drop) between the position 50 mm from the sheet edge and a position 5 mm from the sheet end. In the column entitled Finished Shape of Table 2, the mark "X" stands for Failure, "Δ" stands for Passable, "○" stands for Good, and "◎" stands for Excellent.

It will recognized from Table 2 that the tandem mill according to the present invention can, as compared with the tandem mills of prior art, improve considerably the finished shape particularly edge wave and center buckle as well as the sheet crown and the edge drop. Further, it has been made clear that the Stands Nos. 3 and 4 have only a small effect upon the sheet crown and the edge drop, that the shape correcting capability is increased by providing a rolling mill C at the Stand No. 4 as well as at the last Stand, and that the rolling mills A and B have substantially the same control effect as each other.

(5) The rolling results with respect to the arrangements of rolling mills III and IV of Table 1 are shown in Table 3.

TABLE 3

| | Type of Mill No. | Mill Arrangement Stand No. 1 | 2 | 3 | 4 | 5 | Rolling Results Cr 50 (μ) | ED 50-5 (μ) | Finished Shape |
|---|---|---|---|---|---|---|---|---|---|
| Conventional Method | 1 | N | N | N | N | N | 30 | 50 | X |
| Present Invention | 2 | C | N | N | N | A | 24 | 43 | ○ |
| | 3 | C | N | N | N | B | 24 | 43 | ○ |
| | 4 | C | N | N | N | N | 25 | 44 | X |
| | 5 | C | C | N | N | A | 21 | 39 | ○ |
| | 6 | C | C | N | A | A | 20 | 38 | ◎ |
| | 7 | C | C | N | N | N | 22 | 40 | X |
| | 8 | C | C | C | B | B | 19 | 36 | ◎ |
| | 9 | C | C | C | A | B | 19 | 36 | ◎ |
| | 10 | C | C | C | N | N | 20 | 38 | X |
| | 11 | C | C | C | C | A | 18 | 35 | ◎ |
| | 12 | C | C | C | C | B | 18 | 35 | ◎ |
| | 13 | C | C | C | C | N | 19 | 36 | Δ |

(Size of product, thickness 0.8 mm × width 1220 mm)

The internal pressure of the rolling mill C was set at 500 Kg/cm$^2$, 500 Kg/cm$^2$, 460 Kg/cm$^2$, and 300 Kg/cm$^2$ at the Stands Nos. 1, 2, 3, and 4, respectively.

From Table 3, it will be recognized that the tandem mill according to the present invention can, as compared with the tandem mills of prior art, improve considerably the finished shape particularly edge wave and center buckle as well as the sheet crown and the edge drop. It has further been made clear that the Stands Nos. 3 and 4 have only a small effect upon the sheet crown and the edge drop, that the shape correcting capability is increased by providing a rolling mill C at the Stand No. 4 as well as at the last Stand, and that the rolling mills A and B have substantially the same control effect as each other. It is also clear that the finished profile (sheet crown and edge drop) can be improved by performing high reduction rolling at the upstream Stands namely Stands Nos. 1 and 2 in the Arrangements I~IV of Table 1.

(ii)

HOT ROLLING (1) Typical dimension and function of various rolling mills in the tandem hot rolling mill Rolling Mill A Work Roll: diameter 713 mm×barrel length 2030 mm Back-up Roll: diameter 1480 mm×barrel length 2030 mm Pressure during Sleeve Shift: 300~500 Kg/cm$^2$ Rolling Mill B Work Roll: diameter 590 mm×barrel length 2030 mm Intermediate Back-up Roll: diameter 600 mm×barrel length 2030 mm Back-up Roll: diameter 1280 mm×barrel length 2030 mm
Roll Bending Force: increase 50 ton constant Rolling Mill C
Work Roll: diameter 700 mm×barrel length 2030 mm
Back-up Roll: diameter 1480 mm×barrel length 2030 mm
Medium Pressure: 0~500 Kg/cm²
Value of Sleeve Expansion: maximum 0.26 mm/radius Rolling Mill N
Work Roll: diameter 713 mm×barrel length 2030 mm
Back-up Roll: diameter 1480 mm×barrel length 2030 mm (2) Material Used
Hot rolled strip: thickness 20 (mm×width) 1230 mm (Slab was rolled by a roughing mill to a thickness of 20 mm)

(3) Rolling Condition
The material was rolled by the tandem mill comprising six stands in a schedule for reducing the thickness of the material from the initial thickness of 20 mm gradually to thicknesses of 10.3 mm, 5.5 mm, 3.65 mm, 2.49 mm, 1.97 mm and 1.8 mm, respectively.

The position for establishing the length of the plane of contact between the work roll and the back-up roll of the rolling mills A and B was established at a position 80 mm inwardly of the sheet thickness under no load. The rolling mill C was adjusted to have an internal pressure in the range of 300~500 Kg/cm² in the seleeve roll, and the internal pressure of the sleeve roll was properly adjusted so as to provide a satisfactory exit side shape.

(4) The rolling results with respect to the arrangements of rolling mills I and II of Table 1 are shown in Table 4.

TABLE 4

| | Type of Mill No. | Mill Arrangement Stand No. 1 | 2 | 3 | 4 | 5 | 6 | Rolling Results Cr 50 (μ) | ED 50-5 (μ) | Finished Shape |
|---|---|---|---|---|---|---|---|---|---|---|
| Conventional Method | 1 | N | N | N | N | N | N | 60 | 50 | X |
| Present Invention | 2 | A | N | N | N | N | C | 50 | 45 | ○ |
| | 3 | B | N | N | N | N | C | 50 | 45 | ○ |
| | 4 | A | N | N | N | N | N | 55 | 46 | X |
| | 5 | A | A | N | N | N | C | 45 | 41 | ○ |
| | 6 | A | A | N | N | C | C | 30 | 35 | ◎ |
| | 7 | B | B | N | N | N | N | 40 | 40 | X |
| | 8 | B | B | B | N | C | C | 15 | 28 | ◎ |
| | 9 | B | B | A | A | C | C | 9 | 26 | ◎ |
| | 10 | A | C | C | C | C | C | 8 | 25 | ◎ |
| | 11 | B | C | C | C | C | C | 8 | 25 | ◎ |
| | 12 | N | C | C | C | C | C | 8 | 26 | ◎ |
| | 13 | N | N | N | C | C | C | 16 | 27 | ◎ |

(Size of product, thickness 1.8 mm × width 1250 mm)

In Table 4, the significance of the expressions Cr 50, ED 50-5 and the marks, X, Δ, ○, and ◎ are identical to those of Table 2.

The internal pressure of the rolling mill C was set to 400 Kg/cm², 450 Kg/cm², 460 Kg/cm² and 480 Kg/cm² at the Stands Nos. 2, 3, 4, and 5, respectively. The Stand No. 6 was adjusted from time to time so as to provide satisfactory exit side shape.

From Table 4, it can be recognized that the tandem mill according to the present invention can, as compared with the tandem mills of the prior art, improve considerably both the sheet crown and the edge drop. It has further been made clear that the shape correcting capability is increased by providing a rolling mill C at the Stand No. 4 as well as at the last stand.

It has also been found that the hot rolling of Table 4 involves substantially the same shape control effect as the cold rolling of Table 2.

In the case of cold rolling, the profile control must be performed at upstream stands where the sheet thickness is relatively large, basically because metal flow is very small. In the case of hot rolling, since sufficient effect is not obtained only by the upstream stands, it is desired that the profile control be performed both at the upstream and the midstream stands and the shape control be performed at the lower stands. Satisfactory effects can be obtained also by using a common four-high mill at the upstream stands and starting the profile control at the midstream stands.

(5) The rolling results with respect to the arrangements of rolling mills III and IV of Table 1 are shown in Table 5.

TABLE 5

| | Type of Mill No. | Mill Arrangement Stand No. 1 | 2 | 3 | 4 | 5 | 6 | Rolling Results Cr 50 (μ) | ED 50-5 (μ) | Finished Shape |
|---|---|---|---|---|---|---|---|---|---|---|
| Conventional Method | 1 | N | N | N | N | N | N | 60 | 50 | X |
| Present Invention | 2 | C | N | N | N | N | A | 47 | 45 | ○ |
| | 3 | C | N | N | N | N | B | 47 | 45 | ○ |
| | 4 | C | N | N | N | N | N | 50 | 47 | X |
| | 5 | C | C | N | N | N | A | 39 | 41 | ○ |
| | 6 | C | C | N | N | A | A | 34 | 38 | ○ |
| | 7 | C | C | N | N | N | N | 43 | 43 | X |
| | 8 | C | C | C | N | B | B | 16 | 34 | ◎ |
| | 9 | C | C | A | A | B | B | 12 | 32 | ◎ |
| | 10 | C | C | C | C | C | A | 10 | 30 | ◎ |
| | 11 | C | C | C | C | C | B | 10 | 30 | ◎ |

TABLE 5-continued

| Type of Mill No. | Mill Arrangement Stand No. 1 | 2 | 3 | 4 | 5 | 6 | Rolling Results Cr 50 (μ) | ED 50-5 (μ) | Finished Shape |
|---|---|---|---|---|---|---|---|---|---|
| 12 | C | C | C | C | C | N | 14 | 33 | Δ |

(Size of product, thickness 1.8 mm × width 1000 mm)

The internal pressure of the rolling mill C was set to 450 Kg/cm$^2$, 430 Kg/cm$^2$, 460 Kg/cm$^2$, 480 Kg/cm$^2$ and 490 Kg/cm$^2$ at the Stands Nos. 1, 2, 3, 4 and 5, respectively.

From Table 5, it can be recognized that the tandem mill according to the present invention can, as compared with the tandem mills of prior art, improve considerably both the sheet crown and the edge drop. It has further been made clear that the shape correcting capability is increased by providing a rolling mill A or B at the Stand No. 5 as well as the last stand.

It has thus been found that the hot rolling of Table 5 involves substantially the same shape control effect as the cold rolling of Table 3.

What is claimed is:

1. A tandem mill comprising a plurality of stands, characterized in that the final stand is a sleeve expanding mill, at least one of the stands exclusive of the last stand is a sleeve sliding mill or an intermediate back-up roll shifting mill, and the other stands are common four-high mills.

* * * * *

UNITED STATES PATENT AND TRADEMARK OFFICE

CERTIFICATE OF CORRECTION

PATENT NO. : 4,658,620

DATED : April 21, 1987

INVENTOR(S) : Takeshi Masui, Eizo Yasui and Yukio Matsuda

It is certified that error appears in the above-identified patent and that said Letters Patent is hereby corrected as shown below:

On the title page the Assignee should read

--Sumitomo Metal Industries, Ltd.--

Signed and Sealed this

Eighteenth Day of August, 1987

*Attest:*

*Attesting Officer*

DONALD J. QUIGG

*Commissioner of Patents and Trademarks*